US010758951B2

(12) United States Patent
Sieburg

(10) Patent No.: US 10,758,951 B2
(45) Date of Patent: Sep. 1, 2020

(54) MULTI-CHAMBER ENCLOSED SUPPLY ASSEMBLY FOR INDEPENDENT AND SIMULTANEOUS OPERATIONS OF MULTIPLE PRESSURIZED OR SUCTION DRIVEN TOOLS AND/OR APPLICATIONS OF VARYING SOLUTIONS

(71) Applicant: William Sieburg, Bend, OR (US)

(72) Inventor: William Sieburg, Bend, OR (US)

( * ) Notice: Subject to any disclaimer, the term of this patent is extended or adjusted under 35 U.S.C. 154(b) by 0 days.

(21) Appl. No.: 15/927,983

(22) Filed: Mar. 21, 2018

(65) Prior Publication Data

US 2018/0272394 A1 Sep. 27, 2018

Related U.S. Application Data

(60) Provisional application No. 62/474,139, filed on Mar. 21, 2017.

(51) Int. Cl.

| | |
|---|---|
| ***B08B 9/032*** | (2006.01) |
| ***B08B 9/035*** | (2006.01) |
| ***B08B 9/053*** | (2006.01) |
| ***B08B 9/049*** | (2006.01) |

(52) U.S. Cl.

CPC ..... *B08B 9/0325* (2013.01); *B08B 9/035* (2013.01); *B08B 9/0328* (2013.01); *B08B 9/0495* (2013.01); *B08B 9/0497* (2013.01); *B08B 9/053* (2013.01); *F24F 2221/225* (2013.01)

(58) Field of Classification Search

CPC ... B08B 9/0321; B08B 9/0322; B08B 9/0323; B08B 9/0325; B08B 9/0326; B08B 9/0327; B08B 9/049; B08B 9/0492; B08B 9/0328; B08B 9/035; B08B 9/0495; B08B 9/0497; B08B 9/053; F24F 2221/225

USPC ..... 134/115 R, 172, 195, 22.1, 22.11, 22.12; 15/383

See application file for complete search history.

(56) References Cited

U.S. PATENT DOCUMENTS

| | | | | |
|---|---|---|---|---|
| 2,608,439 | A * | 8/1952 | Bates | B60S 3/048 137/206 |
| 4,756,324 | A * | 7/1988 | Larsson | B08B 9/0495 134/167 C |
| 6,857,436 | B2 | 2/2005 | Labib et al. | |
| 7,143,468 | B2 | 12/2006 | Illingworth et al. | |
| 8,465,597 | B2 * | 6/2013 | Turner | A47L 5/365 134/109 |
| 2014/0224280 | A1 * | 8/2014 | Mather | B05B 5/032 134/22.12 |
| 2015/0209835 | A1 * | 7/2015 | Heuckeroth | B08B 3/026 239/127 |
| 2016/0167257 | A1 * | 6/2016 | Chauvin | B29C 49/12 134/22.1 |

* cited by examiner

*Primary Examiner* — William V Gilbert

(57) ABSTRACT

A device including an outer hose segment, an inner hose segment, a first air chamber for accommodating a first air flow, a second air chamber for accommodating a second air flow, a drive tool coupler into engagement with a first end portion of the outer hose segment and inner hose segment, a cleaning end section that is configured to allow tools to be attached and detached to and from said device, and a hose coupler into engagement with a second end portion of the outer and inner hose segments, wherein the hose coupler is configured to control the first and second flow of air into the first and second air chambers independently.

23 Claims, 13 Drawing Sheets

MULTI-CHAMBER ENCLOSED SUPPLY ASSEMBLY FOR INDEPENDENT AND SIMULTANEOUS OPERATIONS OF MULTIPLE PRESSURIZED OR SUCTION DRIVEN TOOLS AND/OR APPLICATIONS OF VARYING SOLUTIONS

CROSS-REFERENCE TO RELATED APPLICATIONS

The present Utility patent application claims priority benefit of the U.S. provisional application for patent serial number 62474139 entitled "A CLEANING DEVICE", filed on Mar. 21, 2017, under 35 U.S.C. 119(e). The contents of this related provisional application are incorporated herein by reference for all purposes to the extent that such subject matter is not inconsistent herewith or limiting hereof

RELATED CO-PENDING U.S. PATENT APPLICATIONS

Not Applicable.

INCORPORATION BY REFERENCE OF SEQUENCE LISTING PROVIDED AS ATEXT FILE

Not Applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to cleaning devices. More particularly, certain embodiments of the invention relates to a cleaning device comprising multiple tools within one assembly.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon. It is believed that cleaning air ducts and/or drains can be a labor intensive task due to the common need to twist and force rigid hoses down flexible and/or turning ducts and/or pipes. Air duct cleaning technicians often use a combination of agitation tools to clean an HVAC system. Such tools may include blaster balls which use high pressure air to propel themselves down the duct lines by blasting air backwards towards the technician. Blaster balls are typically easy to use yet may not adequately agitate the duct walls to remove dirt and debris. Other agitation tools such as whips and brushes may be attached to rigid hoses and forced down the duct lines. These types of tools may be more effective at cleaning; however, when using such tools, it may often be difficult to reach the further end of the air ducts due to factors such as turns in the ducts and the length of the ductwork. Duct cleaning is often a two-person task since the process of manipulating hoses can be challenging and binding issues, where hoses and/or air lines become stuck or turned around in the air ducts, may occur. Often, technicians may use multiple passes with different tools to effectively clean air ducts. In addition to cleaning tools, technicians may also use video cameras on the ends of lines to inspect HVAC and plumbing, while cleaning. One may expect that technicians may experience similar problems to those mentioned above which may make it difficult to convey the cameras to the desired locations.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a perspective side view of the cleaning device. FIG. 1B is a diagrammatic side view of the cleaning device, and FIG. 1C is a cross sectional side view of the cleaning device with a connected air whip;

FIG. 6A is a partially transparent diagrammatic side view, and FIGS. 6B & 6C are partially transparent diagrammatic top views;

FIG. 7A is a partially transparent diagrammatic side view. FIG. 7B is a perspective side view, and FIG. 7C is a rear view;

FIG. 9*a* is a cross sectional side view of the hose assembly. FIG. 9*b* is a sectional top view of the hose assembly.

Figure 1A:
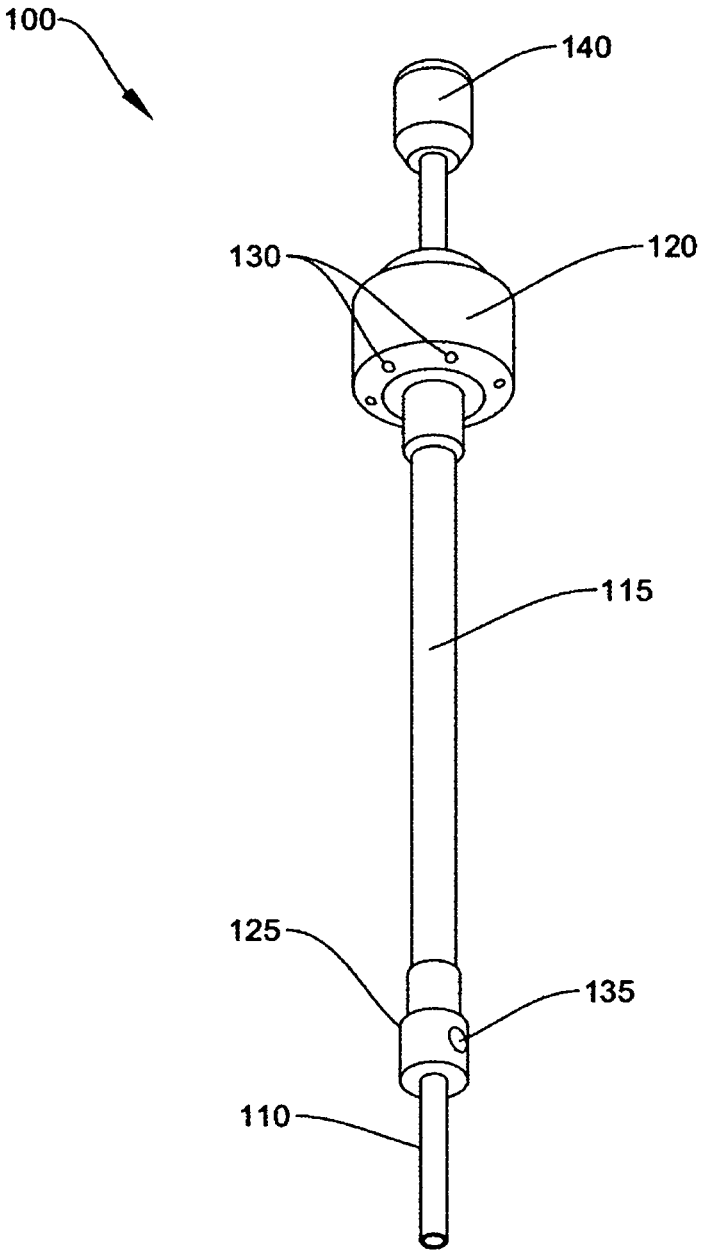
FIGS. 1A, 1B, and 1C illustrate an exemplary cleaning device comprising multiple tools within one assembly, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' does not broaden the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Hence, for at least the forgoing reason, Applicants submit that it is improper for any examiner to hold as indefinite any claims of the present patent that employ any words of approximation.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction with, some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn.112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of" and "consisting essentially of" where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide a cleaning device comprising multiple tools within one assembly. Some embodiments may be implemented as an air hose which can expel pressurized air or water through a component to propel the hose assembly forward and comprises one or more additional air, liquid, or electrical powered devices that can be operated independently of or together with the propelling component. Some embodiments may comprise couplers to create multiple pressurized chambers that may be independently controlled by technicians in a number of applications.

Figure 1B:
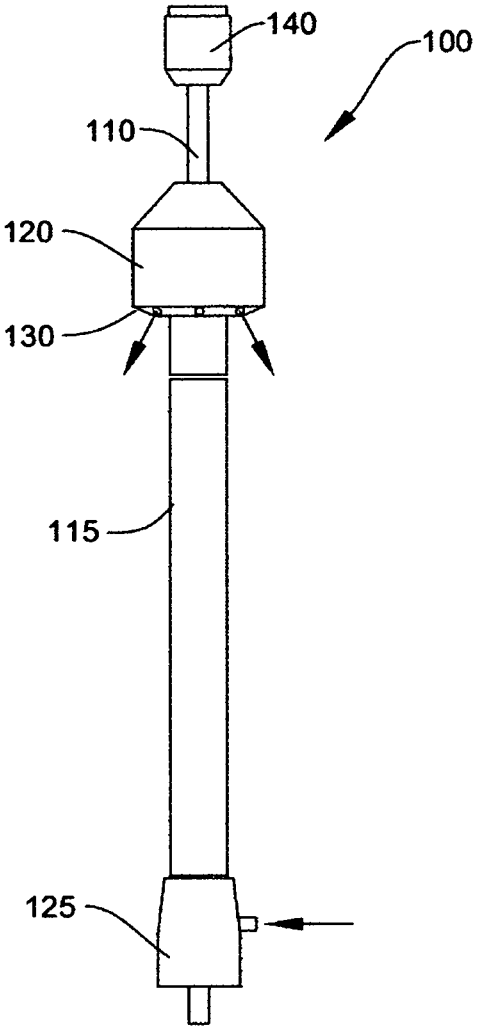
Figure 1C:
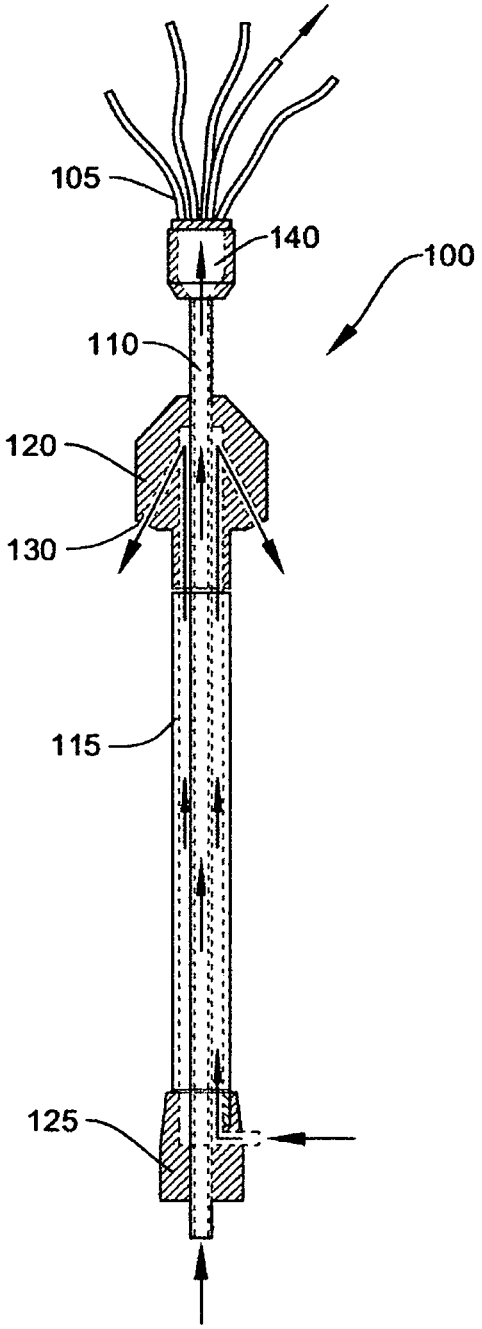

FIGS. 1A, 1B, and 1C illustrate an exemplary cleaning device 100 comprising multiple tools within one assembly, in accordance with an embodiment of the present invention. FIG. 1A is a perspective side view of cleaning device 100. FIG. 1B is a diagrammatic side view of cleaning device 100, and FIG. 1C is a cross sectional side view of cleaning device 100 with a connected air whip 105. In the present embodiment, cleaning device 100 comprises an inner hose 110 that runs through an outer hose 115. A drive tool coupler 120 and a hose coupler 125 are located at each end of the outer hose 115 to typically enable the flow of air into inner hose 110 and the flow of air into outer hose 115 to be controlled independently. The configuration of inner hose 110 and outer hose 115 creates two air chambers, a chamber being the space within inner hose 110 and a second chamber being the space between the inner hose 110 and outer hose 115. Inner hose 110 and outer hose 115 may be flexible hoses or may be rigid components, similar to the components of a spray handle. It is contemplated that in some embodiments the inner hose and outer hose may be made of different types of hose or tubing. For example, without limitation, in one such embodiment the inner hose may be more rigid than the outer hose. In other embodiments the outer hose may be more rigid than the inner hose. A multiplicity of suitable materials may be used to form the components of cleaning device 100 including, without limitation, plastic, metal, or rubber. Moreover, the components may be connected to each other using various different means such as, but not limited to, threaded connections, welding, adhesive, or compression fittings. In addition, seals, gaskets, O-rings, etc. may be used at these connections to help prevent the loss of air or liquid from the system when appropriate.

In the present embodiment, drive tool coupler 120 is located near the cleaning end section of cleaning device 100 and comprises a plurality of hole components 130 that may enable air from the chamber between inner hose 110 and outer hose 115 to be forced out the back of drive tool coupler 120 to propel cleaning device 100, along with any attached tools, forward through a duct or pipe. The round shape of drive tool coupler 120 may enable the airflow escaping through holes 130 to be evenly distributed around cleaning device 100, which may help ensure that cleaning device 100 travels straight forward and may help prevent cleaning device 100 from getting bound up or turned around within a duct or pipe. Alternate embodiments may comprise holes of various different shapes and sizes through which the airflow may escape such as, but not limited to, elongated slots or nozzle-shaped channels. Furthermore, the tube within a tube configuration of the present embodiment may also help to prevent tangling and kinking of inner hose 110 and outer hose 115. Inner hose 110 may enable an air-driven agitation device, such as, but not limited to, air whip 105, to be controlled by the air within inner hose 110 once cleaning device 100 reaches a desired position. Air valves, similar to those illustrated by way of example in FIG. 6A and 6B, near the technician end of cleaning device 100, opposite from the cleaning end, may enable a technician to control the air flow to both drive tool coupler 120 and air whip 105. For example, without limitation, one air valve may be connected to hose coupler 125 at a receiver 135 to control the air flow into the space between inner hose 110 and outer hose 115, and another air valve may be located on the technician end of inner hose 110 to control the air flow into inner hose 110. These separate air flows may be operated together or independently as desired. In an alternate embodiment, a single air valve may be used to control the flow of air into both chambers simultaneously. Those skilled in the art will readily recognize, in light of and in accordance with the teachings of the present invention, that drive tool coupler 120 and any attached tools may be operated with means other than the flow of air such as, but not limited to, the flow of gasses other than air, liquid, or electricity. The tools and attached devices may be controlled by remote control, electrical solenoids, any electrical switches, or mechanical valve control. In some embodiments a combination of means may be used. For example, without limitation, in one such embodiment the flow of gas or liquid may be used to operate a drive tool coupler for propulsion of an electrical device, such as, but not limited to, a camera or powered brushes, attached to an electrical cord within the inner hose.

In typical use of the present embodiment, cleaning device 100 may be used for cleaning air ducts in an HVAC system. A technician may insert cleaning device 100 into a duct cleaning end first then may turn on the flow of air to outer hose 115 and drive tool coupler 120 to propel cleaning device 100 through the duct. The air flow to inner hose 110 may also be turned on so that air whip 105 may be able to agitate debris within the duct as cleaning tool 100 travels down the duct. Alternatively, the flow of air to inner hose 110 may remain off until cleaning device 100 reaches a desired location within the duct at which point the air flow to inner hose 110 may be turned on to operate air whip 105. Both the air used to drive the cleaning tool and the cleaning tool itself are both controlled at the technician's end of the cleaning device. While using the said device, the system would be under a negative air pressure, pulling out the debris that is dislodged by the agitation tool. It is contemplated that a multiplicity of suitable tools may be attached to cleaning device to be propelled through a duct or pipe such as, but not limited to, brushes, sponges, sprayers, cameras, video scopes, vacuums, lights, or magnets. Moreover in the present embodiment, the tool attached to cleaning device 100 may be interchangeable to typically enable a technician to customize the cleaning technique according to the requirements of the current task. One way to accomplish this is to provide a tool coupler 140 with means that may allow for to tools to be attached and detached to and from the cleaning end of cleaning device 100. Such means may include, without limitation, threaded connectors, compression fit connectors, and drill chuck type devices, quick connect fittings, injection molds, castings, and set screws. In other embodiments the tool coupler may be built into the drive tool coupler. In some applications, drive tool coupler 120 may be replaced with other types of tools if propulsion is not needed such as, but not limited to, sprayers or vacuums.

It is believed that the use of drive tool coupler 120 may enable tools such as, but not limited to, whips, brushes, sprayers, and video scopes to reach much farther down ducts or pipes than when no propulsion means are used. This may enable the technician to clean portions of ducts that may have been inaccessible or difficult to access due to various factors including, but not limited to, the length of ducts and turns. Moreover, cleaning device 100 may enable the technician to clean a duct or pipe in one pass by using multiple tools with a single run. Although the foregoing embodiment is described as being used in cleaning applications, some embodiments may be implemented to be used in a variety of other applications such as, but not limited to, painting, pneumatic tools, plumbing, mold remediation, automotive repair or restoration, automotive detailing, electrical work, or other trades that need to reach areas that are inaccessible without an extension tool. Furthermore, such embodiments may be used in locations other than ducts or pipes including, without limitation, conduits, behind appliances, spaces between walls, crawlspaces, spaces between machinery, or any other difficult to access locations. Furthermore, the technology may be used for controlling multiple operations that are pressure operated such as shower heads, sinks, misters, etc.

Those skilled in the art will readily recognize, in light of and in accordance with the teachings of the present invention, that a multiplicity of suitable tools may be attached to or integrated into cleaning devices that allow for multiple air, liquid, or electrical driven tools to be operated. Furthermore, these tools may be provided in various different configurations to be used in different types of applications. FIG. 2 through FIG. 5 illustrates some examples of such embodiments.

Figure 2:
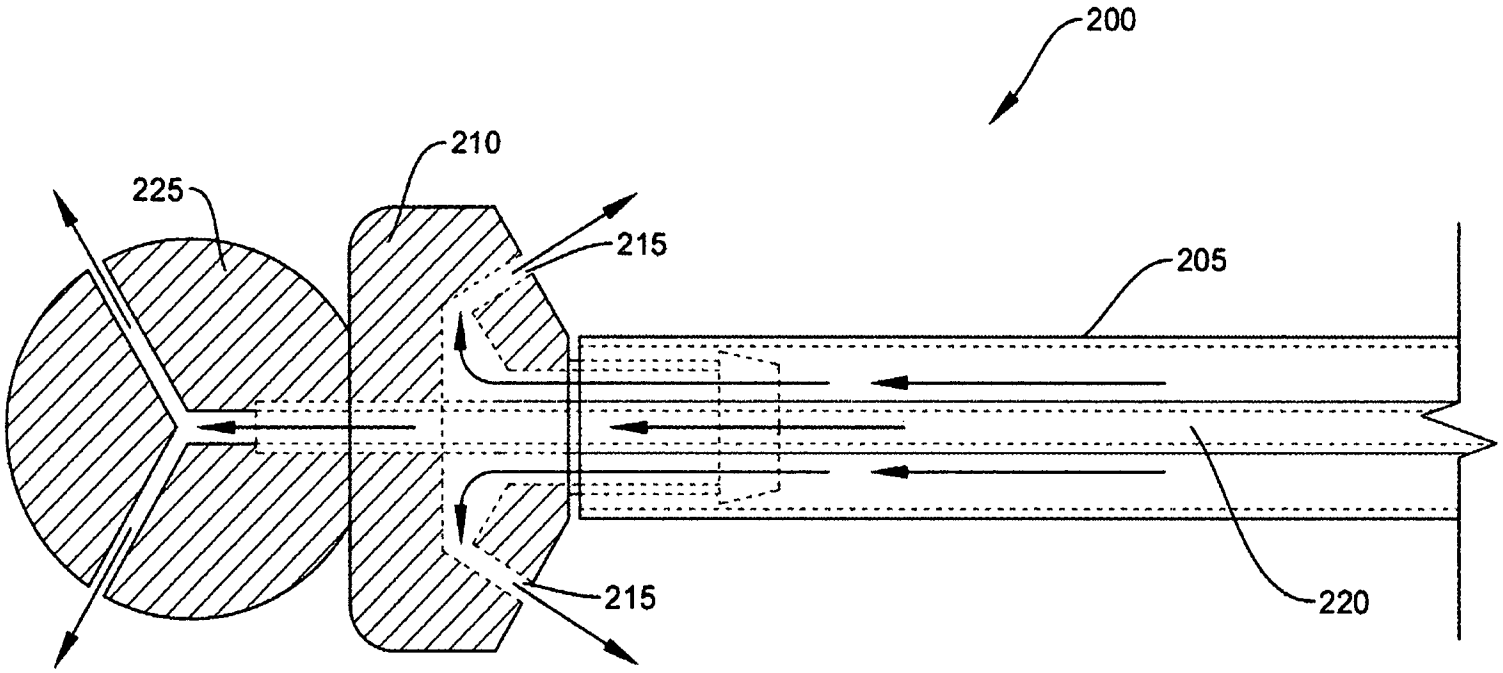
FIG. 2 is a partially transparent diagrammatic side view of a spraying end of an exemplary multiple use device that may be used as a self-propelled sprayer, in accordance with an embodiment of the present invention.

FIG. 2 is a partially transparent diagrammatic side view of a spraying ends of an exemplary multiple use device 200 that may be used as a self-propelled sprayer, in accordance with an embodiment of the present invention. In the present embodiment, an outer hose 205 may be attached to a pressurized air or liquid supply. This air or liquid supply travels through outer hose 205 to a drive tool coupler 210 and is forced backwards through channels 215 to propel device 200 forward. An inner hose 220 may be connected to a pressurized liquid supply to be expelled from a sprayer 225. Various different types of liquids may be expelled from sprayer 225 including, without limitation, a solution for cleaning and/or sanitation, water, paint, or sealant.

Figure 3:
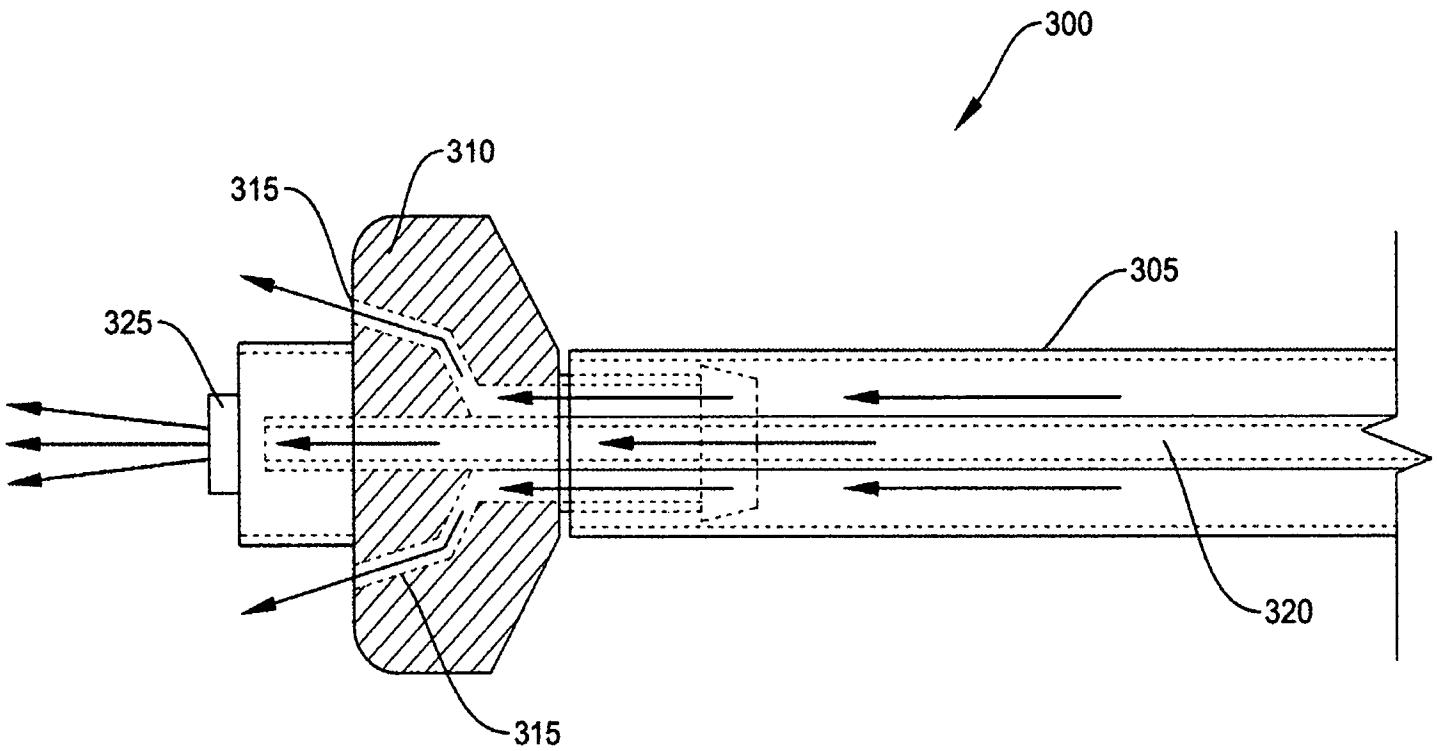
FIG. 3 is a partially transparent diagrammatic side view of a spraying end of an exemplary multiple use device that may be used to spray multiple liquids, in accordance with an embodiment of the present invention.

FIG. 3 is a partially transparent diagrammatic side view of a spraying end of an exemplary multiple use device 300 that may be used to spray multiple liquids, in accordance with an embodiment of the present invention. In the present embodiment, an outer hose 305 may be attached to a pressurized liquid supply. This liquid supply travels to a spray tool coupler 310 and is forced forward through channels 315. An inner hose 320 may be connected to a pressurized liquid supply to be expelled from a sprayer 325. Device 300 may be implemented as a flexible hose type assembly or may be implemented with rigid components to form a spray handle or wand, such as a paint sprayer gun and pressure washer. Device 300 may enable a user to perform a multiple step cleaning process with a single tool since multiple solutions may be sprayed concurrently or in succession. For example, without limitation, inner hose 320 may be connected to a water supply while outer hose 305 may be connected to a soap solution to typically enable a user to clean an object with the soap solution then rinse the soap solution from the object. It is contemplated that the liquid supplies may be easily changed at receivers located near the base of device 300 so that multiple types of liquids may be used in a single cleaning process such as, but not limited to, pre-wash solutions, engine degreaser, tire cleaner, window cleaning solution, abrasive solutions, bleach, sanitizers, or anti-mold solutions. Furthermore, device 300 may be used for applications other than cleaning. For example, without limitation, device 300 may be used to water and fertilize plants, to spray soap and water in a shower or dog wash, or to spray different colors of paint. In addition, a fire hose could use the technology to allow "foaming" agent to be "injected in fire hose to allow firefighters to spray water-only and "water with foaming agent (or similar products) as required directly from the end of the hose at the spray nozzle. This would greatly reduce the cleanup after a fire with respect to harmful anti-fire agents and give firefighters greater control over their environment.

Figure 4:
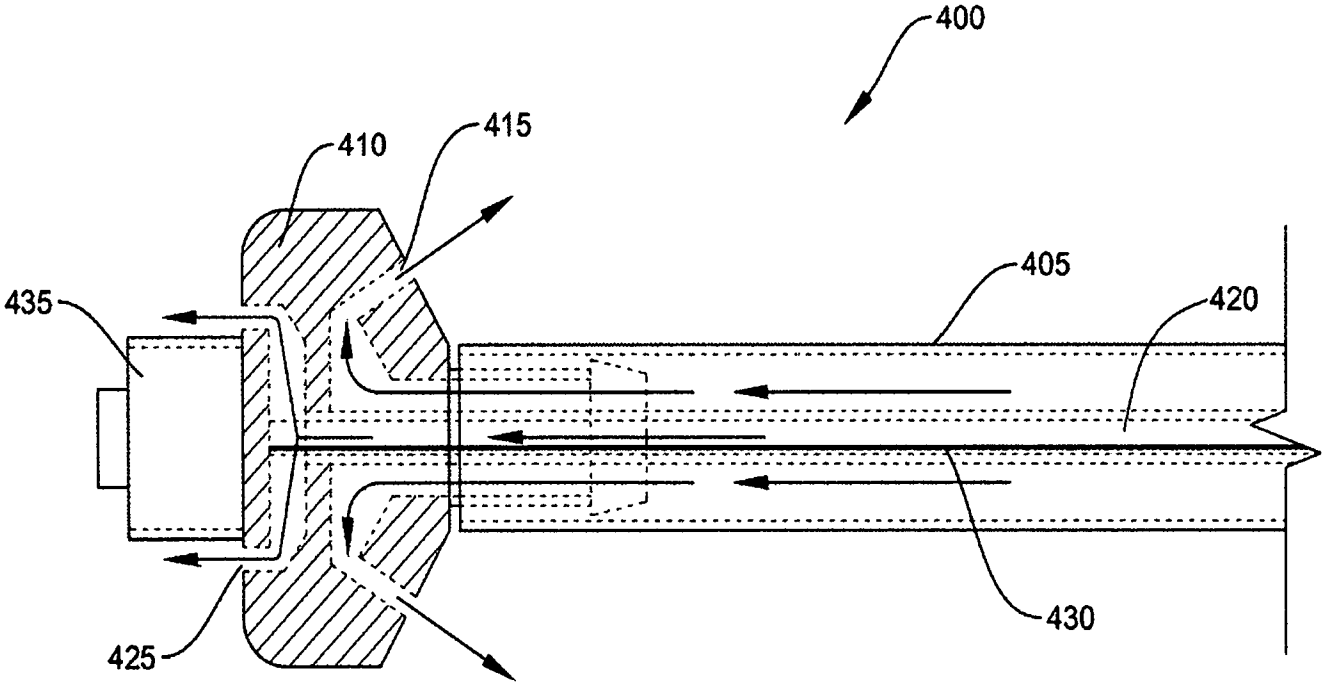
FIG. 4 is a partially transparent diagrammatic side view of an exemplary multiple use device that may be used as a self-propelled camera, in accordance with an embodiment of the present invention.

FIG. 4 is a partially transparent diagrammatic side view of an exemplary multiple use device 400 that may be used as a self-propelled camera, in accordance with an embodiment of the present invention. In the present embodiment, an outer hose 405 may be attached to a pressurized air supply. This air supply travels through outer hose 405 to a drive tool coupler 410 and is forced backwards through channels 415 to propel device 400 forward. An inner hose 420 may be connected to the same air supply or a separate air supply or a solution/paint/to be expelled from optional forward facing channels 425, to be used to expel air for pushing debris, liquid solution for sanitization, or to drive another cleaning device, such as a whip, brush or similar device as mentioned before In addition, an electrical cable 430 may run through inner or outer hose 420 to power a camera tool 435, such as, but not limited to, a still camera or a video scope. In the present embodiment camera tool 435 may be propelled into difficult to access locations by drive tool coupler 410 to typically enable a technician to view areas that may have been previously unattainable.

Figure 5:
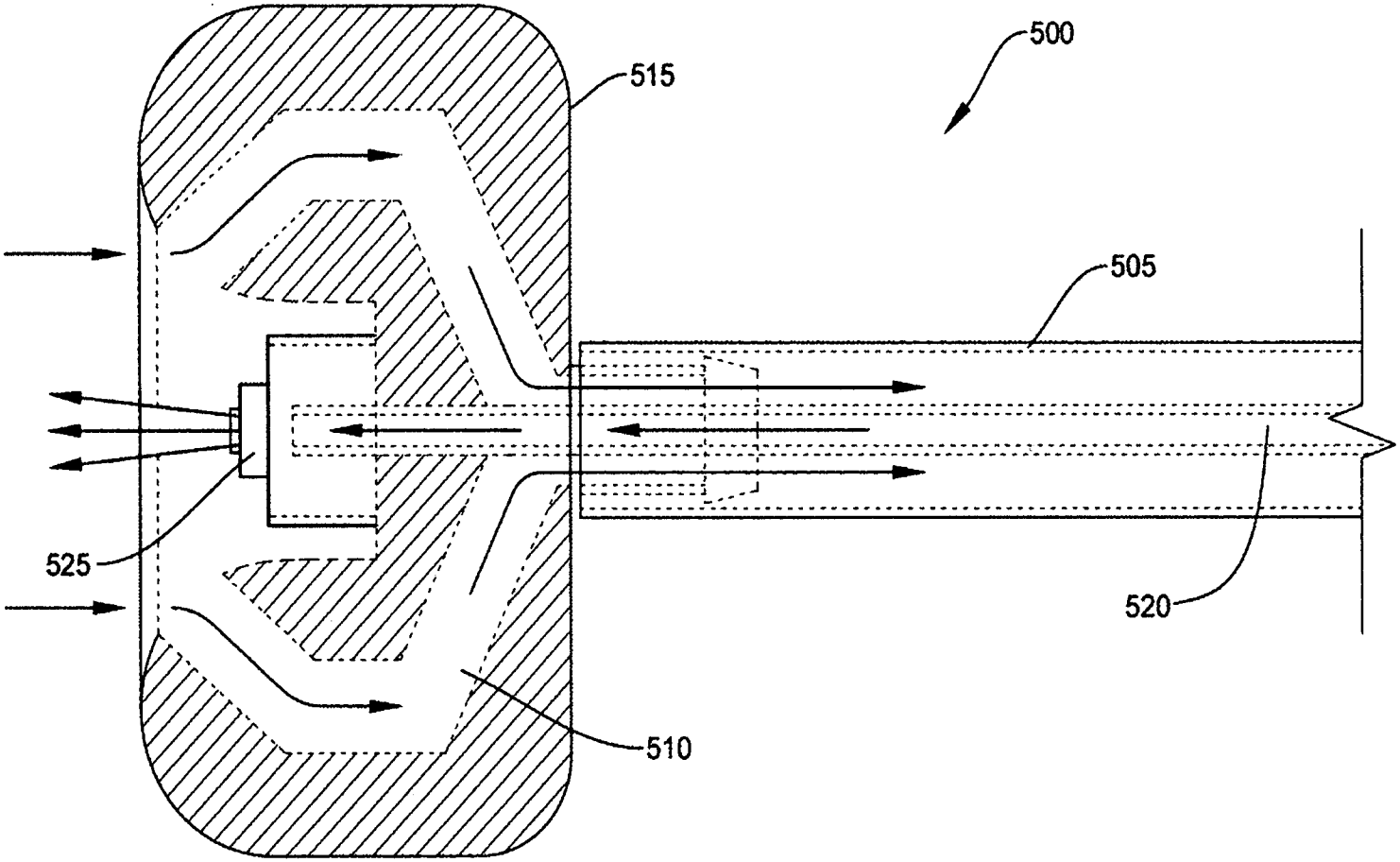
FIG. 5 is a partially transparent diagrammatic side view of an exemplary multiple use device that may be used as a cleaning and vacuuming system, in accordance with an embodiment of the present invention.

FIG. 5 is a partially transparent diagrammatic side view of an exemplary multiple use device 500 that may be used as a cleaning and vacuuming system, in accordance with an embodiment of the present invention. In the present embodiment, an outer hose 505 may be attached to a vacuum device and vacuum channels 510 in a vacuum tool coupler 515. An inner hose 520 may be connected to a pressurized air or liquid supply to be expelled from a sprayer 525. It is believed that the cleaning and vacuuming system may be better able to clean a surface with less mess with the use of air/ liquid jets being expelled from sprayer 525 to agitate or remove dust and debris from the surface to be cleaned prior to or concurrent with vacuuming by vacuum tool coupler 515. In some applications, liquids such as, but not limited to, water or cleaning solutions may be expelled through sprayer 525 and vacuumed through vacuum tool coupler along with debris. Non-limiting examples of such applications may include a dental hygiene device to combine pressurized water cleaning and suction in the same tool and cleaning with pressurized water in environments where excessive water unwanted. In addition, the system can be integrated into a home vacuum cleaner or shop vacuum in conjunction with a compressed air supply. Said air supply can be redirected from exhaust of vacuum to be injected into the floor to be cleaned. Vacuum tool coupler 515 may be made of rubber, plastic, or a similar material that may be suitable for capturing debris and liquids.

Figure 6A:
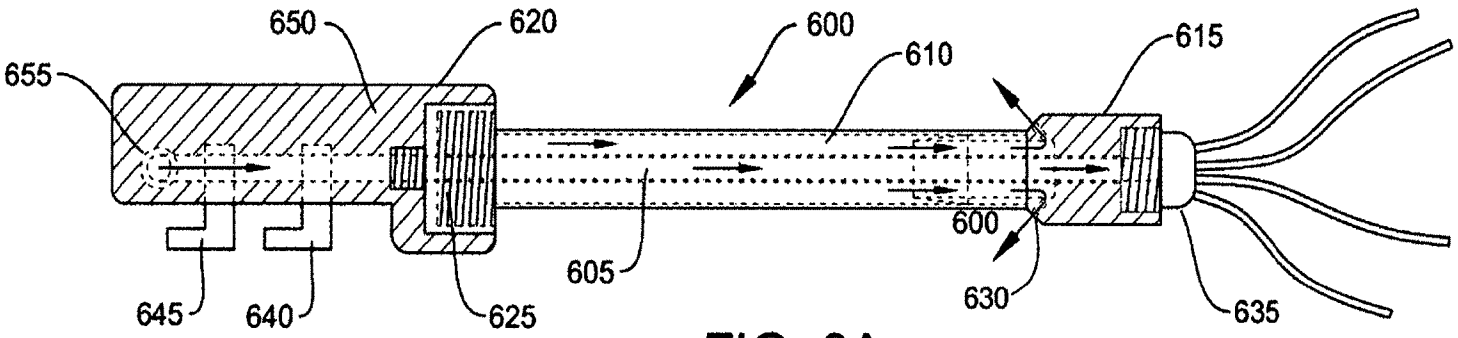
FIGS. 6A, 6B & 6C illustrate exemplary cleaning devices with technician controls that may be able to operate multiple tools, in accordance with an embodiment of the present invention.
Figure 6B:
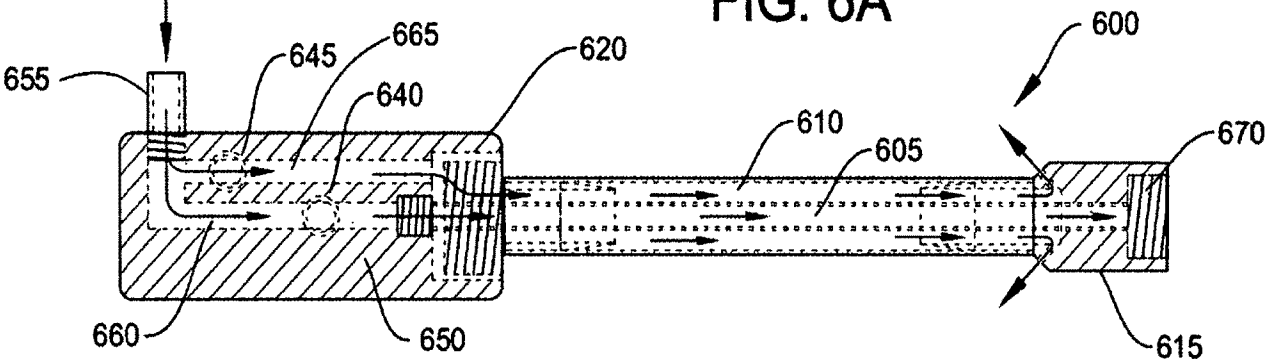
Figure 6C:
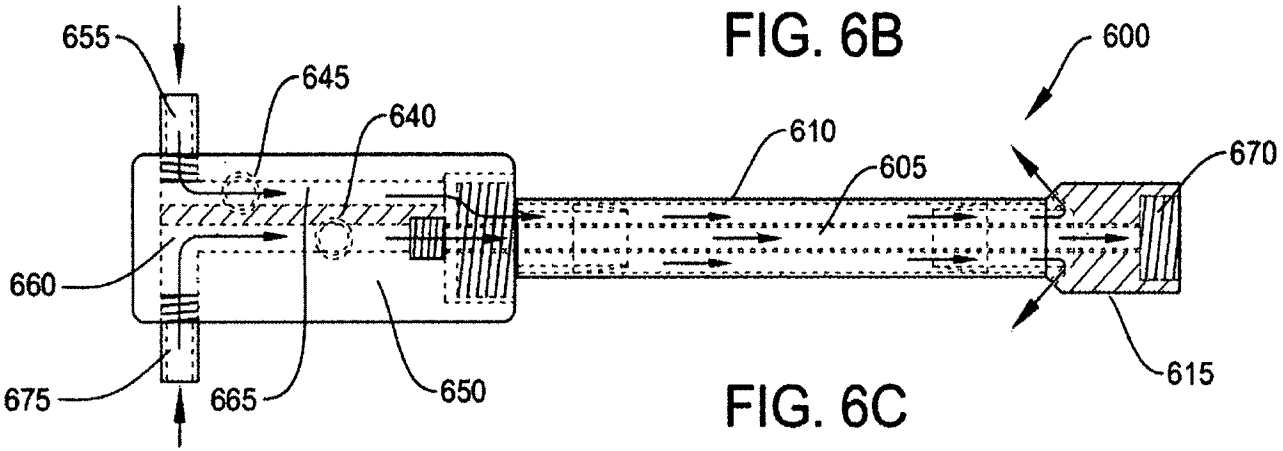

FIGS. 6A, 6B and 6C illustrate an exemplary cleaning device 600 with technician controls that may be able to operate multiple tools, in accordance with an embodiment of the present invention. FIG. 6A is a partially transparent diagrammatic side view, and FIGS. 6B and 6C are partially transparent diagrammatic top views. In the present embodiment, cleaning device 600 comprises an inner hose 605 that runs through an outer hose 610. A drive tool coupler 615 and a hose coupler 620 are located at each end of outer hose 610 to typically enable the flow of air into Inner hose 605 and the flow of air into outer hose 610 to be controlled independently. A compression fitting 625 may be used at the point where inner hose 605 passes through hose coupler 620 to seal the end of inner hose 605 at hose coupler 620. Drive tool coupler 615 is located near the cleaning end of cleaning device 600 and comprises holes 630 that may enable air from the air chamber between inner hose 605 and outer hose 610 to be forced out the back of drive tool coupler 615 to propel the cleaning end of cleaning device 600 forward through a duct or pipe. In the present embodiment, inner hose 605 may enable an air-driven agitation device, such as, but not limited to, an air whip 635, to be controlled by the air within inner hose 605. Air valves 640 and 645 in a control panel 650 at the technician end of cleaning device 600 may enable a technician to control the air flow to both drive tool coupler 615 and air whip 635. Referring to FIG. 6B, a main air supply 655 enters control panel 650 and splits into an inner hose air supply 660 and an outer hose air supply 665. The flow of inner hose air supply 660 may be controlled by air valve 640, and the flow of outer hose air supply 665 may be controlled by air valve 645. Air valves 640 and 645 are shown by way of example as inserted valves that block or allow the flow of air through device 600. Referring to FIG. 6C, a main pressurized gas or liquid supply 655 enters control panel 650 to supply outer hose gas or liquid supply 665 and a secondary gas or liquid supply 675 enters control panel 650 to supply inner hose gas or liquid supply 660. Alternate embodiments may comprise various different types of controls including, without limitation, switches, levers, or dials. The separate air flows may be operated together or independently as desired. It is contemplated that drive tool coupler 615 and any attached tools may be operated with means other than the flow of air such as, but not limited to, the flow of other gasses or liquids. In the present embodiment, a threaded connector 670 on drive tool coupler 615 may enable tools such as, but not limited to, air whip 635, other types of agitation tools, cameras, sprayers, or vacuum heads to attach to cleaning device 600. Optionally, an electrically controlled device, such as, but not limited to, a camera, video scope, or light, may be attached to deaning device 600 in addition to or instead of a secondary tool operated by pressurized air or liquid. The electrical supply for the electrically controlled device may be supplied by a cord running through inner hose 605 or outer hose 610.

In typical use of the present embodiment, cleaning device 600 may be used for cleaning air ducts in an HVAC system. A technician may insert cleaning device 600 into a duct cleaning end first then may turn on the flow of air to outer hose 610 and drive tool coupler 615 with air valve 645 to propel the cleaning end of cleaning device 600 through the duct. The air flow to inner hose 605 may also be turned on with air valve 640 so that air whip 635 may be able to agitate debris within the duct as cleaning tool 600 travels down the duct. Alternatively, the flow of air to inner hose 605 may remain off until the cleaning end of cleaning device 600 reaches a desired location within the duct at which point the technician may turn off the air flow of outer hose 610 to stop the forward movement of drive tool coupler 615 and turn on the air flow to inner hose 605 with air valve 640 to activate air whip 635.

Figure 7A:
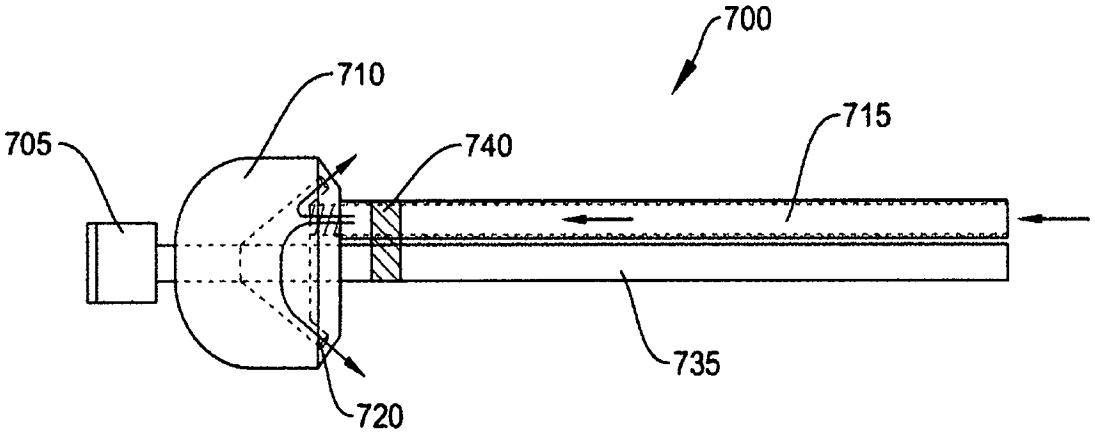
FIGS. 7A, 7B and 7C illustrate an exemplary aftermarket attachment device that may be connected to an existing device for the use of propelling the existing device and/or operating multiple devices at the same time, in accordance with an embodiment of the present invention.
Figure 7C:
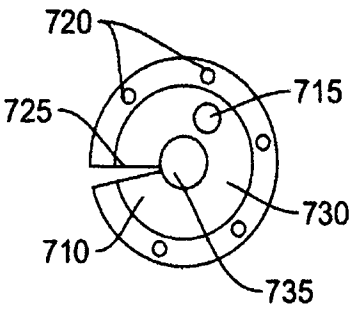
Figure 7B:
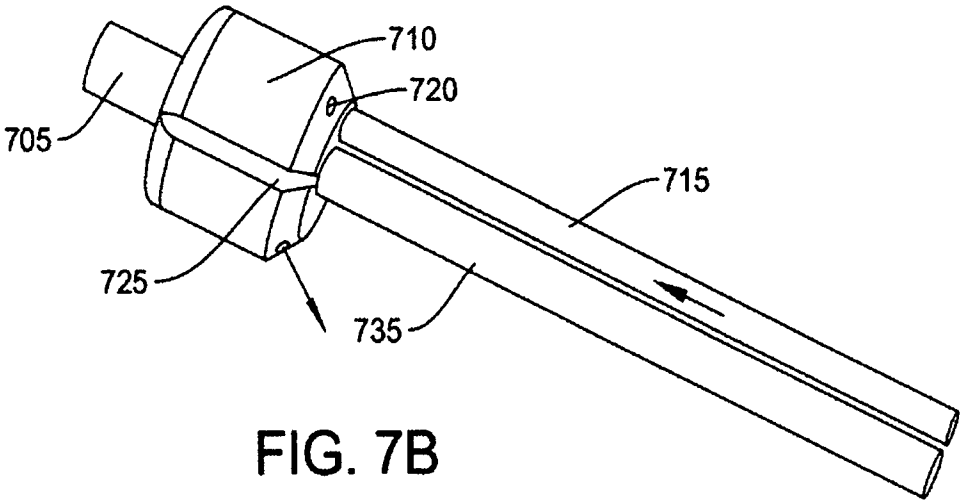

FIGS. 7A, 7B and 7C illustrate an exemplary aftermarket attachment device 700 that may be connected to an existing device 705 for the use of propelling existing device 705 and/or operating multiple devices at the same time, in accordance with an embodiment of the present invention. FIG. 7A is a partially transparent diagrammatic side view. FIG. 7B is a perspective side view, and FIG. 7C is a rear view. In the present embodiment, device 700 comprises an air or liquid pressurized drive tool 710 connected to a supply hose 715 which may supply pressurized air or liquid. This air or liquid is expelled through holes 720 in the back of drive tool 710 to propel drive tool 710 forward. A notch connected to a center hole 730 in drive tool 710 may enable a cord 735 to be inserted into drive tool 710. In some applications the exiting tool may comprise a hose or rigid tube to which drive tool 710 may be attached rather than a cord. Drive tool 710 may be made of a flexible material such as, but not limited to, rubber or plastic, which may make it easier for drive tool 710 to be placed over cord 735. Optionally, a strap 740 may also be wrapped around cord 735 and drive hose 715 to further secure device 700 to existing device 705. In alternate embodiments, a multiplicity of suitable means may be used to attach the drive tool to the existing device including, but not limited to, multiple straps, clamps, elastic bands, screws, and brackets.

In typical use of the present embodiment, once drive tool 710 is attached to existing device 705, the flow of air or liquid may be turned on to drive tool 710 to propel existing device 705 to a desired location. Then, the flow of air or liquid may be turned off so that existing device 705 may be used at the desired location. Existing device 705 may be an electrical device such as, but not limited to, a video scope or camera or may be a device operated by pressurized air or liquid such as, but not limited to, an air whip, a sprayer, a vacuum. In applications where propulsion is not required, an embodiment comprising a tool other than a drive tool may be integrated into the aftermarket attachment device.

Figure 8A:
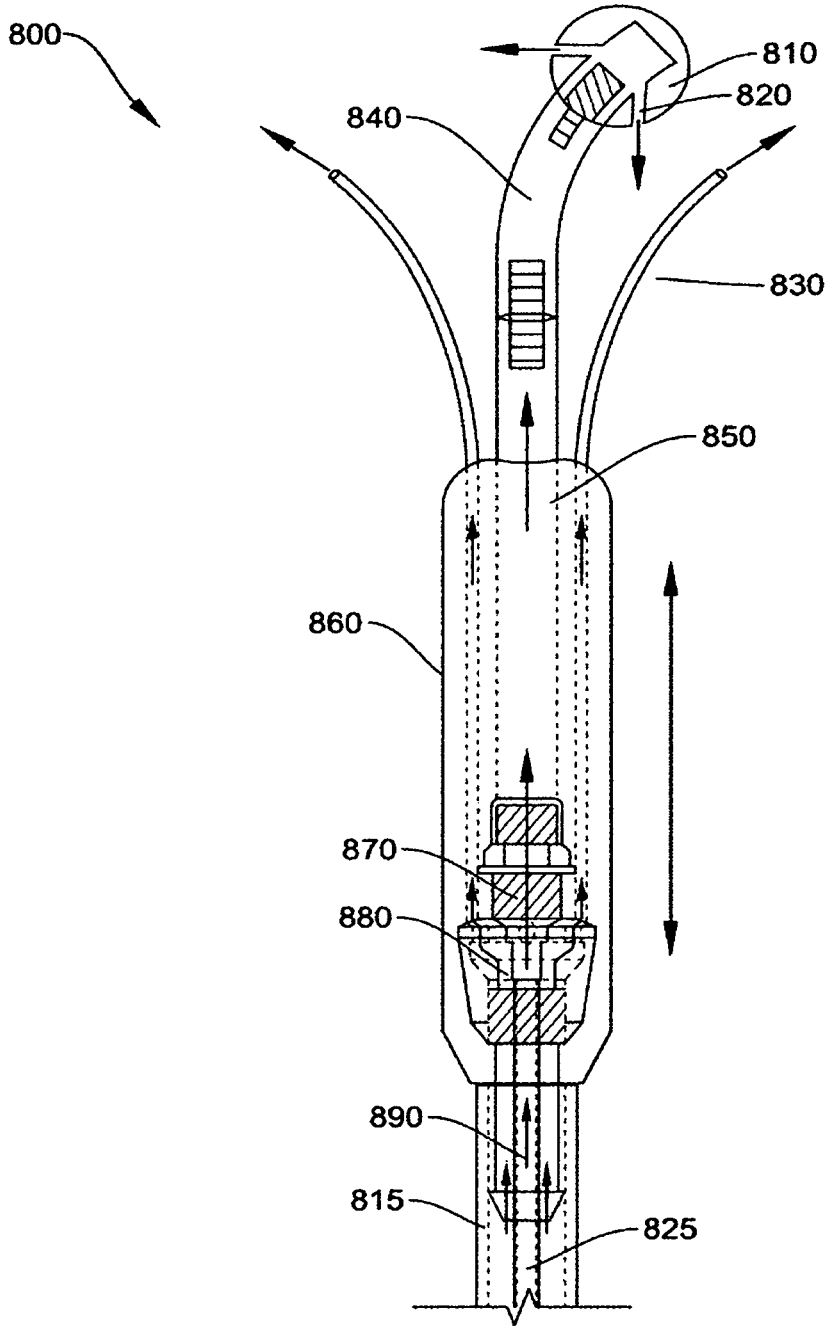
FIGS. 8A and 8*b* are diagrammatic side views of an exemplary tool attachment of an adjustable portion of a multi-use device, in accordance with an embodiment of the present invention.
Figure 8B:
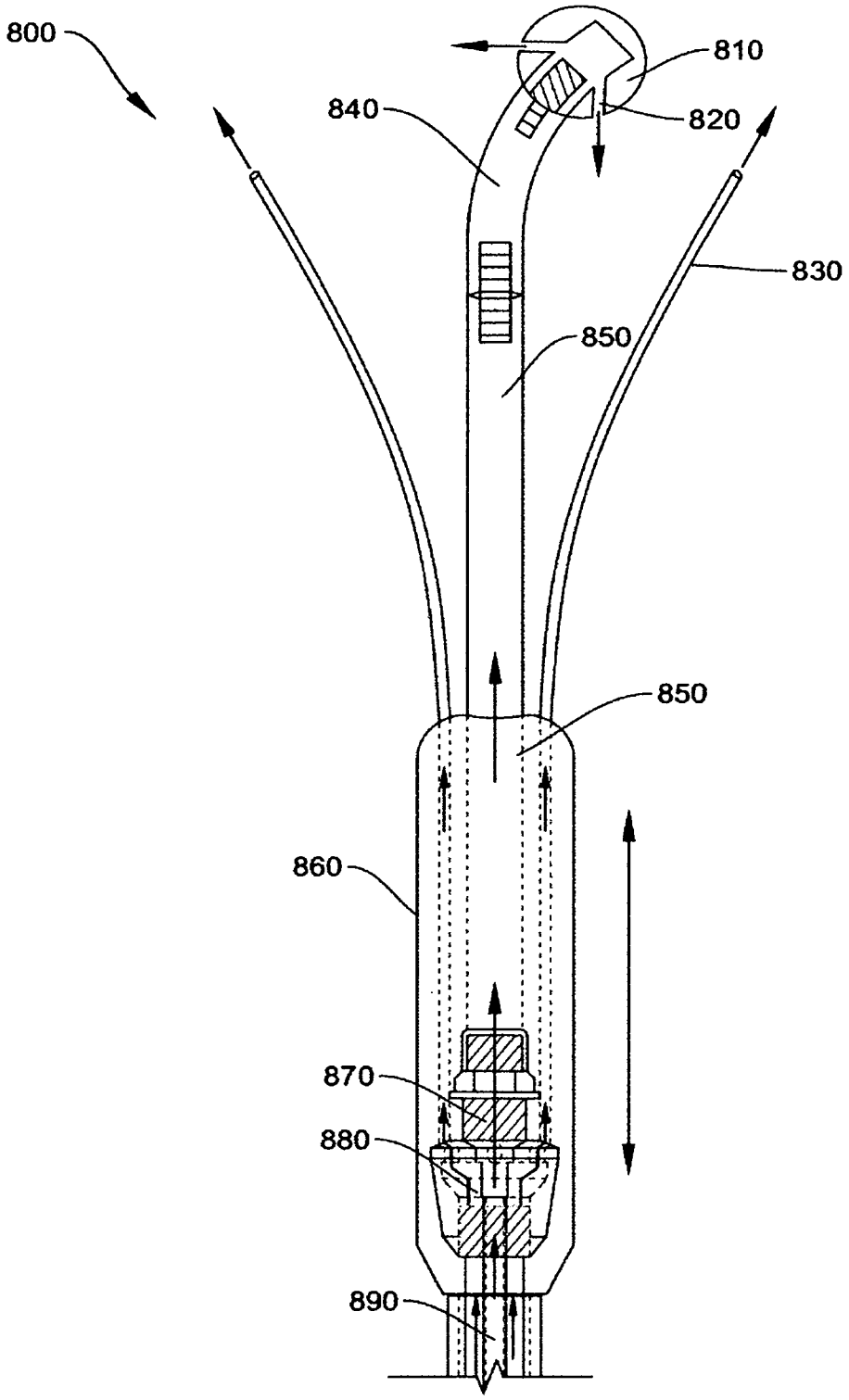

FIGS. 8A and 8*b* are diagrammatic side views of an exemplary tool attachment of an adjustable portion of multi-use device 800 that may be used to adjust the length of agitation whips for cleaning, control jets for propulsion and/or any tool's position on device 800 for the distribution of solution/paint/propulsion and inspection or mechanical procedure/operation in accordance with an embodiment of the present invention. In the present embodiment, an outer hose 815 may be attached to a pressurized air supply. This air supply travels to an air whip couplers and may be forced forward through the whips 830 within the adjustable sheath 860. An inner hose 825 may be connected to the same air supply to be expelled from the drive tool attachment 810 and is forced backwards through channels 820 to propel device 800 forward. Device 800 may enable user to perform a multiple step cleaning process with a single tool since tool 800 can be adjusted to fit and reach multiple sizes of cavities/spaces to be cleaned/inspected. For example, without limitation, adjustable sheath 860 may be adjusted in a forward position as depicted in 8*a* to shorten length of agitation whips for cleaning smaller ducts or in a backward position as depicted in 8*b* for larger cavities or any position in between for varying size ducts/cavities. A flexible portion of hose 840 may be attached to allow tool to be pulled around corners with the drive tool attachment. Furthermore, device 800 can be used for applications other than cleaning. For example, without limitation, attachment 860 may be utilized to adjust lighting display for cleaner images, adjust distances between tool attachments, and even inflate balloons to block the flow of air or liquids beyond a point or to dislodge/move materials blocking a duct or similar environment. Said balloon can give handler the ability to grip the walls of cavity and allow for greater control/force in using pneumatic, electrical or other pressure driven system to clean, dislodge or address any other related need.

Figure 9A:
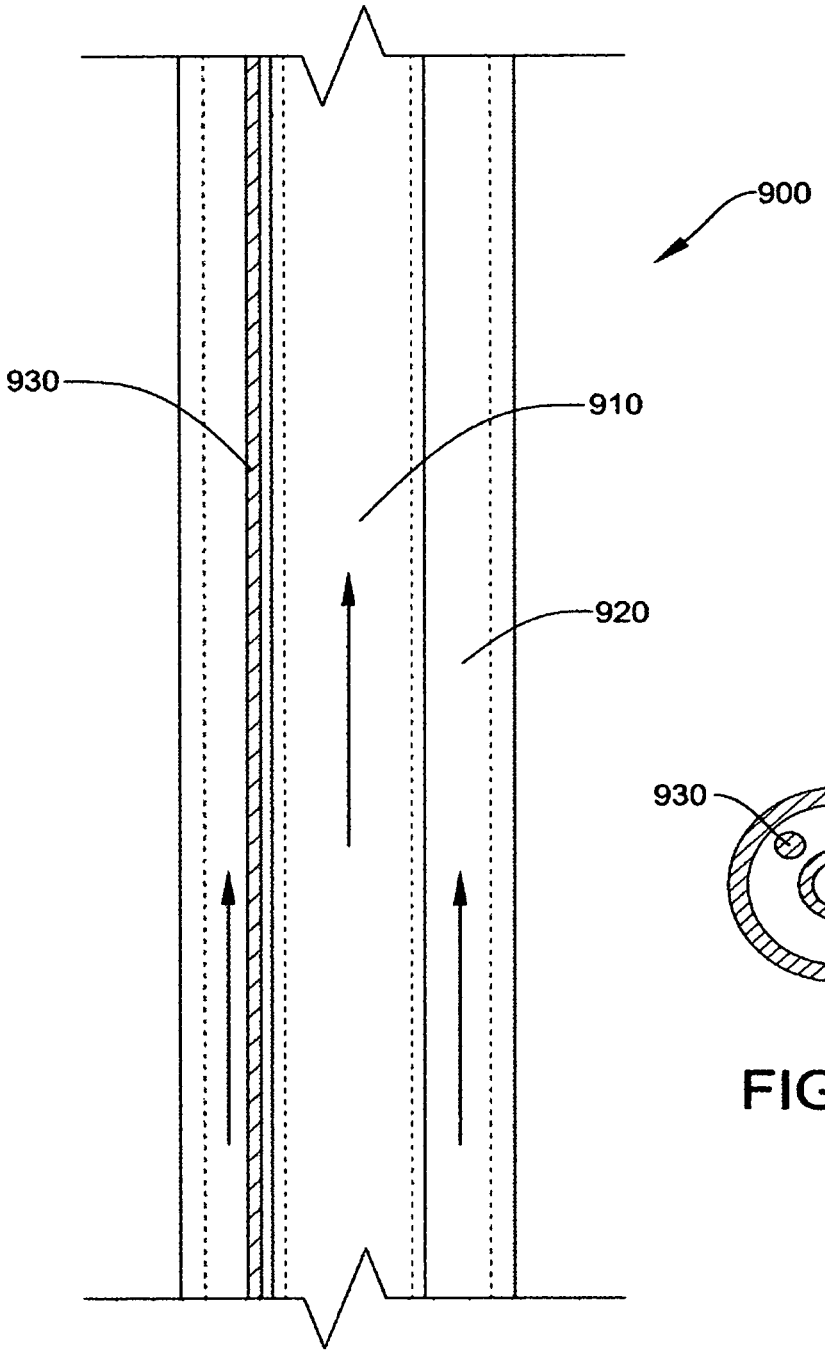
FIGS. 9*a* and 9*b* illustrate an exemplary assembly comprising a rigid support member incorporated in accordance with an embodiment of the present invention.
Figure 9B:
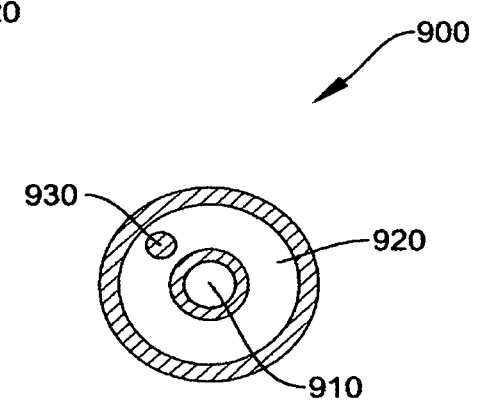

FIGS. 9*a* and 9*b* illustrate an exemplary assembly 900 comprising a rigid support member incorporated in accordance with an embodiment of the present invention. FIG. 9*a* is a cross sectional side view of the hose assembly 900. FIG. 9*b* is a sectional top view of the hose assembly 900. In the present embodiment, hose assembly 900 may comprise a rigid/elastic support rod 930 inserted between inner hose 910 and outer hose 920 to allow user to push the tools down larger and longer cavities/chases and/or reach distances where flexibility is required and rigid systems are unusable. Support rod 930 compensates for the recoil effect of the inner hose 910 and outer hose 920. In addition, without limitation, the support member 930 can be embedded in the inner hose 910, outer hose 920 or dual hose FIG. 10, when manufactured for greater stability and rigidity. Support rod may be made of metal, fiberglass, plastic or similar composite.

Figure 10:
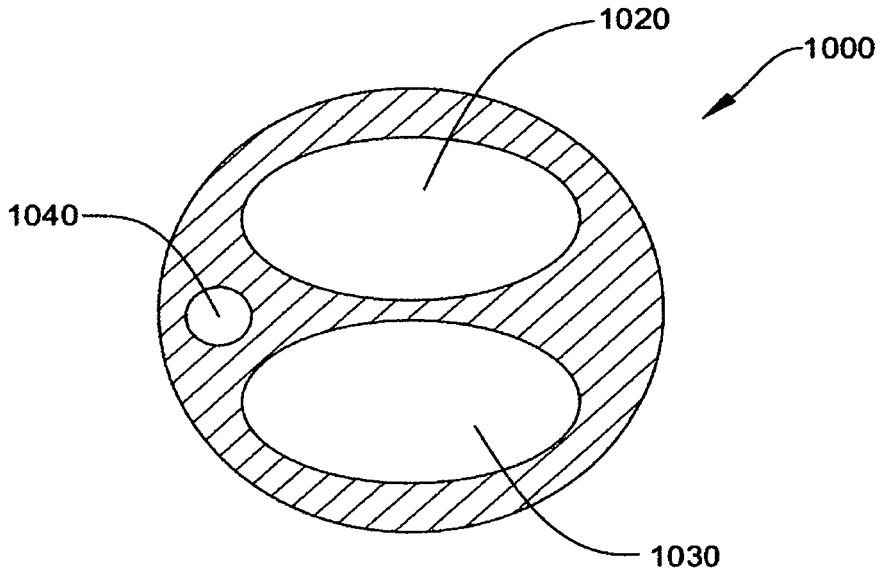
FIG. 10 is a cross section view of a hose, in accordance with an embodiment of the present invention.

FIG. 10 is a cross section view of a hose, in accordance with an embodiment of the present invention. in the present embodiment shown, a one (1) hose 100 with two chambers, a first chamber 1020 and a second chamber 1030. Proprietary couplers may be designed to receive the shape of the individual chambers 1020 and 1030. In addition, the chambers 1020 and 1030 may differ in size to allow for the amount of flow of various solutions, air and/or controlled substances including but not limited to solids, and sands for sand-blasting, etc. In the present embodiment, hose assembly 1000 may comprise a rigid/ elastic support red member 1040 embedded in hose 1000 to allow user to push the tools down larger and longer cavities/ chases and/or reach distances where flexibility is required and rigid systems are unusable. In addition, without limitation, the support member 1040 can be embedded in the hose 1000, when manufactured for greater stability and rigidity. Support red member may be made of metal, fiberglass, plastic or similar composite.

Figure 11:
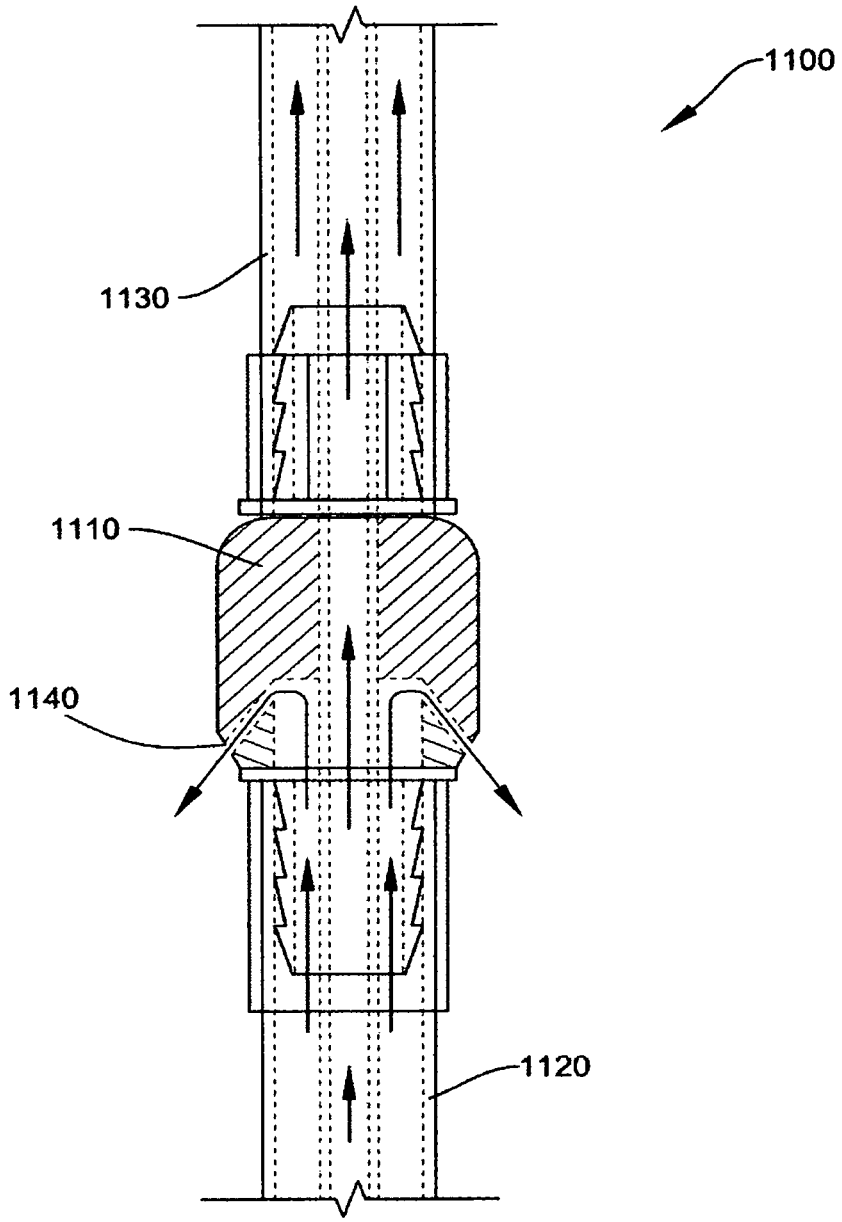
FIG. 11 illustrate an exemplary intermediate in-line coupler, in accordance with an embodiment of the present invention.

FIG. 11 is an intermediate in-line coupler 1110 to allow dispersion of said air, liquids or solutions along the length of the hose assembly through coupler holes 1140, as desired. In-line coupler 1110 may be twisted or "turned-on/off" as required for air-driven support to pull the assembly farther, or dispersion of said supplied pressurized elements. The coupler 1140 splits the outer hose into two parts, 1120 & 1130 of assembly and allows pressurized air or fluid to flow out of it throught holes 1140, whips, or similar applications. Intermediate in-line coupler 1110 may allow dispersion of said air, liquids or solutions along the length of the hose assembly as desired.

Those skilled in the art will readily recognize, in light of and in accordance with the teachings of the present invention, that some embodiments may be implemented in configurations other than those described in the foregoing. For example, without limitation, some embodiments may be implemented as a stand-alone device with a side-by-side hose assembly design with couplers that perform similar functions to those mentioned above. These embodiments would look similar to the embodiment illustrated by way of example in FIGS. 7A, 7B, and 7C yet would not be attached to an existing device. Other embodiments may comprise two or more separate couplers that can expel gas or liquids with equal distribution around the hose or assembly. These couplers may be similar to the drive tool couplers described in some of the foregoing embodiments and may expel the gas or liquid in various different directions. Yet other embodiments may comprise hoses, tubes, and cords that are not round and straight in shape including, but not limited to square tubing, flat cords, coiled hoses, tapered hoses, and hoses with ridges.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

It is noted that according to USA law 35 USC § 112 (1), all claims must be supported by sufficient disclosure in the present patent specification, and any material known to those skilled in the art need not be explicitly disclosed. However, 35 USC § 112 (6) requires that structures corresponding to functional limitations interpreted under 35 USC § 112 (6) must be explicitly disclosed in the patent specification. Moreover, the USPTO's Examination policy of initially treating and searching prior art under the broadest interpretation of a "mean for" claim limitation implies that the broadest initial search on 112(6) functional limitation would have to be conducted to support a legally valid Examination on that USPTO policy for broadest interpretation of "mean for" claims. Accordingly, the USPTO will have discovered a multiplicity of prior art documents including disclosure of specific structures and elements which are suitable to act as corresponding structures to satisfy all functional limitations in the below claims that are interpreted under 35 USC § 112 (6) when such corresponding structures are not explicitly disclosed in the foregoing patent specification. Therefore, for any invention element(s)/structure(s) corresponding to functional claim limitation(s), in the below claims interpreted under 35 USC § 112 (6), which is/are not explicitly disclosed in the foregoing patent specification, yet do exist in the patent and/or non-patent documents found during the course of USPTO searching, Applicant(s) incorporate all such functionally corresponding structures and related enabling material herein by reference for the purpose of providing explicit structures that implement the functional means claimed. Applicant(s) request(s) that fact finders during any claims construction proceedings and/or examination of patent allowability properly identify and incorporate only the portions of each of these documents discovered during the broadest interpretation search of 35 USC § 112 (6) limitation, which exist in at least one of the patent and/or non-patent documents found during the course of normal USPTO searching and or supplied to the USPTO during prosecution. Applicant(s) also incorporate by reference the bibliographic citation information to identify all such documents comprising functionally corresponding structures and related enabling material as listed in any PTO Form-892 or likewise any information disclosure statements (IDS) entered into the present patent application by the USPTO or Applicant(s) or any 3rd parties. Applicant(s) also reserve its right to later amend the present application to explicitly include citations to such documents and/or explicitly include the functionally corresponding structures which were incorporate by reference above.

Thus, for any invention element(s)/structure(s) corresponding to functional claim limitation(s), in the below claims, that are interpreted under 35 USC § 112 (6), which is/are not explicitly disclosed in the foregoing patent specification, Applicant(s) have explicitly prescribed which documents and material to include the otherwise missing disclosure, and have prescribed exactly which portions of such patent and/or non-patent documents should be incorporated by such reference for the purpose of satisfying the disclosure requirements of 35 USC § 112 (6). Applicant(s) note that all the identified documents above which are incorporated by reference to satisfy 35 USC § 112 (6) necessarily have a filing and/or publication date prior to that of the instant application, and thus are valid prior documents to incorporated by reference in the instant application.

Having fully described at least one embodiment of the present invention, other equivalent or alternative methods of implementing a device comprising multiple tools within one assembly according to the present invention will be apparent to those skilled in the art. Various aspects of the invention have been described above by way of illustration, and the specific embodiments disclosed are not intended to limit the invention to the particular forms disclosed. The particular implementation of the device may vary depending upon the particular context or application. By way of example, and not limitation, the devices described in the foregoing were principally directed to applications in industrial and trade type settings implementations; however, similar techniques may instead be applied to non-industrial applications including, without limitation, DIY applications, personal care applications, and recreational applications, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

Additionally, if long lengths are required or rigid lines used, "in-line" couplers with twist or quick connect options can be added to a main starter line to increase the length of the assembly. Furthermore, additional drive couplers can be used to propel a longer hose assembly from "mid" sections of the hose assembly. Furthermore, a hose assembly may be constructed with multiple drive jet couplers along the length of the hose assembly (or similar) that can be twisted on (or activated by methods mentioned previously) to allow jets to propel the line from mid sections as the line is being inserted into the duct or cavity to be addressed.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A device comprising:

an outer hose segment, in which said outer hose segment comprises a first end portion and a second end portion;

an inner hose segment, wherein said inner hose segment comprises a first end portion and a second end portion, said inner hose segment being configured to run through said outer hose segment;

a first chamber, wherein said first chamber being disposed through said inner hose segment;

a second chamber, wherein said second chamber being disposed through a space between said inner hose segment and said outer hose segment;

a pressure coupler, wherein said pressure coupler is into engagement with said first end portions of said outer hose segment and said inner hose segment;

a tool end section attached to said second end portions of said inner hose segment and said outer hose segment, wherein said tool end section is configured to allow a tool to be attached and detached to and from said device; and a hose coupler or valve into engagement with said first end portions, wherein said hose coupler or valve is configured to be operable for enabling a first flow or suction of air, a gas, a liquid or a solution into said first chamber and a second independent flow or suction of said air, said gas, said liquid or said solution into said second chamber to be controlled independently.

2. The device of claim 1, further comprising a receiver, wherein said receiver is operable for engaging said device with a source of said air, said gas, said liquid or said solution.

3. The device of claim 2 wherein said valve comprises a first valve into engagement with said inner hose segment, wherein said first valve is configured to control the flow of said air, said gas, said liquid or said solution into said first chamber.

4. The device of claim 3 wherein said valve comprises a second valve into engagement with said second chamber, wherein said second valve is configured to control the flow of said air, said gas, said liquid or said solution into said second chamber.

5. The device of claim 4 further comprising a control panel, wherein said control panel is configured to control the flow and of said air, said gas, said liquid or said solution through said first chamber.

6. The device of claim 5 further comprising at least one of a threaded connector, compression fit connectors, drill chuck type devices, quick connect fittings, injection molds, castings and set screws that is configured to enable attachment of said tool to said device.

7. The device of claim 6, further comprising a compression fitting, wherein said compression fitting is configured to seal said engagement of said first end portion of said inner hose segment with said hose coupler.

8. The device of claim 1, in which said inner hose segment and said outer hose segment further comprise a support rod implement, wherein said support rod implement is configured to compensate for a recoil effect of said inner hose segment and said outer hose segment.

9. The device of claim 1, further comprising a plurality of pneumatic tools, sprayers, pressure driven systems, or controlling operations that are pressure operated, or any such combination having dual controls that are configured to operate independently of each other and are controlled by said device and/or a supply end of an assembly of said device.

10. The device of claim 1, where said hose segments are configured side-by-side.

11. The device of claim 1, further comprising a drive tool coupler with a plurality of hole components, wherein said drive tool coupler is configured to enable said air, said gas, said liquid or said solution or a combination of said gas and said liquid or said solution from said chamber between said inner hose segment and said outer hose segment to be forced out of said plurality of hole components to propel said device forward.

12. The device of claim 11, further comprising a notch segment where, said notch segment is configured to enable attachment of said drive tool coupler to an independent device consisting of at least one of, a cord, a hose, and a rigid tube, to assist with propelling said independent device forward.

13. The device of claim 1, further comprising an agitation whip and an adjustment mechanism that is configured to adjust the length of said agitation whip for cleaning or propulsion.

14. The device of claim 1, wherein said hose segments are manufactured as one hose with two chambers; further comprising a resilient, flexible support member or rod embedded in said hose segments at manufacturing to a reduce recoil effect of said hose segments.

15. The device of claim 1, further comprising an inflatable balloon configured to attach to said device, said inflatable balloon being operable for substantially blocking the flow of said air or said liquid.

16. A device comprising:

means for enclosing a first chamber;

means for enveloping a second chamber;

means for coupling a first end and a second end of said first chambers;

means for coupling a first end and a second end of said second chamber and said enveloping means;

means for allowing a tool to be attached and detached to and from said device;

means for enabling a first flow of air, a liquid or a solution into said first chamber and a second flow of said air, said liquid or said solution into said second air chamber to be controlled independently;

means for propelling said device forward;

means for engaging said device with a source for said air, said liquid or said solution; and means for controlling the flow of said air, said liquid or said solution into said first chamber.

17. A device comprising:

a first inner hose segment, in which said first inner hose segment comprises a first end portion and a second end portion, wherein said first inner hose segment is configured to run a first air flow;

a second outer hose segment, wherein said second outer hose segment comprises a first end portion and a second end portion, wherein said outer hose segment is configured to envelop said inner hose segment, wherein said second outer hose segment is configured to run a second air flow between said inner hose segment and said outer hose segment;

a first air chamber, wherein said first air chamber is configured to run said first air flow through said first hose segment;

a second air chamber, wherein said second air chamber is configured to run said second air flow through said second hose segment;

a drive tool coupler into engagement with said second end portion of said second outer hose segment and said second end portion of said inner hose segment;

a cleaning or application end section, wherein said cleaning or application end section is configured to allow a tool to be attached and detached to and from said device;

a hose coupler into engagement with said first end portion of said inner hose segment and said first end portion of said outer hose segment, wherein said hose coupler is configured to control said first flow of air into said first air chamber and said second air flow into said second air chamber to be controlled independently; and a plurality of hole components in said drive tool coupler, wherein said drive tool coupler is configured to enable air from said air chambers to be forced out of said plurality of hole components to propel said device forward.

18. The device of claim 17 further comprising a receiver, wherein said receiver is operable for engaging said device with a supply source.

19. The device of claim 18, further comprising a first valve into engagement with said first hose segment, wherein said first valve is configured to control said first supply flow into said first chamber.

20. The device of claim 19, further comprising a second valve into engagement with said second hose segment, wherein said second valve is configured to control said second supply into said second chamber.

21. The device of claim 20, further comprising a control panel, wherein said control panel is configured to control said first air flow through said first chamber.

22. The device of claim 21, further comprising a connector that is configured to enable attachment of said tool to said device.

23. The device of claim 22, further comprising couplers to allow additional hose or tube segments to be connected to each other for greater length.

* * * * *